US010814151B2

(12) United States Patent
Bacchin et al.

(10) Patent No.: US 10,814,151 B2
(45) Date of Patent: Oct. 27, 2020

(54) HOUSING DEVICE FOR HOSES OF FIRE EXTINGUISHERS AND/OR FIRE HYDRANTS

(71) Applicant: Tenet S.r.l., Casale sul Sile (IT)

(72) Inventors: Paolo Bacchin, Casale sul Sile (IT); Manuele Cavalli, Casale sul Sile (IT)

(73) Assignee: Tenet S.r.l., Casale sul Sile (IT)

( * ) Notice: Subject to any disclaimer, the term of this patent is extended or adjusted under 35 U.S.C. 154(b) by 22 days.

(21) Appl. No.: 16/097,317

(22) PCT Filed: Apr. 28, 2017

(86) PCT No.: PCT/IT2017/000090
§ 371 (c)(1),
(2) Date: Oct. 29, 2018

(87) PCT Pub. No.: WO2018/087788
PCT Pub. Date: May 17, 2018

(65) Prior Publication Data

US 2019/0134442 A1 May 9, 2019

(30) Foreign Application Priority Data

Apr. 29, 2016 (IT) ..... 102016000044291

(51) Int. Cl.
*A62C 13/76* (2006.01)
*A62C 37/50* (2006.01)
*A62C 33/04* (2006.01)

(52) U.S. Cl.
CPC ..... *A62C 13/76* (2013.01); *A62C 37/50* (2013.01); *A62C 33/04* (2013.01)

(58) Field of Classification Search
CPC ..... A62C 13/76; A62C 13/78; A62C 33/04; A62C 37/50; F17C 2270/0754
See application file for complete search history.

(56) References Cited

U.S. PATENT DOCUMENTS 2,489,339 A 11/1949 Stroop
2,946,389 A * 7/1960 Barnes ..... A62C 13/003 169/75

(Continued)

FOREIGN PATENT DOCUMENTS

CN 202342728 7/2012
CN 105073206 11/2015

(Continued)

OTHER PUBLICATIONS

International Search Report and the Written Opinion dated Sep. 22, 2017 From the International Searching Authority Re. Application No. PCT/IT2017/000090. (9 Pages).

(Continued)

*Primary Examiner* — Alex M Valvis

(57) ABSTRACT

A housing device for hoses of fire extinguishers and/or hydrants, wherein the fire extinguisher and/or hydrant comprises a portion (10) including a valve group (11) connected to a tank containing powder and/or liquid to be dispensed, a hose (16) provided with a nozzle (17) for dispensing the powder and/or the liquid contained within the tank, a handle (12) and a control lever (13) whereby a hole or opening (14) is provided for housing the nozzle (17); in particular, a cover element (15) having a seat where the dispensing nozzle (17) is housed is placed inside the hole or opening (14).

8 Claims, 3 Drawing Sheets

(56) References Cited

U.S. PATENT DOCUMENTS

| | | | | |
|---|---|---|---|---|
| 7,891,241 | B2 * | 2/2011 | McSheffrey | A62C 37/50 169/23 |
| 2015/0328488 | A1 * | 11/2015 | Bacchin | A62C 37/50 169/23 |
| 2018/0311520 | A1 * | 11/2018 | Kim | A62C 13/64 |

FOREIGN PATENT DOCUMENTS

| | | |
|---|---|---|
| CN | 105288923 | 2/2016 |
| DE | 2620909 | 11/1977 |
| WO | WO 2014/102838 | 7/2014 |
| WO | WO 2018/087788 | 5/2018 |

OTHER PUBLICATIONS

Notification of Office Action and Search Report dated Mar. 24, 2020 From the State Intellectual Property Office of the People's Republic of China Re. Application No. 201780026455.2. (7 Pages).

Rapporto di Ricerca e Opinione Scritta [Search Report and Written Opinion] dated Dec. 12, 2016 From the Ministero dello Sviluppo Economico, Direzione Generale Sviluppo Produttivo e Competitivita Uffico Italiano Brevetti e Marchi Re. Application No. IT UA20163036. (7 Pages).

Translation Dated Jun. 3, 2020 of Notification of Office Action dated Mar. 24, 2020 From the State Intellectual Property Office of the People's Republic of China Re. Application No. 201780026455.2. (8 Pages).

* cited by examiner

HOUSING DEVICE FOR HOSES OF FIRE EXTINGUISHERS AND/OR FIRE HYDRANTS

RELATED APPLICATIONS

This application is a National Phase of PCT Patent Application. PCT/IT2017/000090 having International filing date of Apr. 28, 2017, which claims the benefit of priority of Italian Patent Application No. 102016000044291 filed on Apr. 29, 2016. The contents of the above applications are all incorporated by reference as if fully set forth herein in their entirety.

FIELD AND BACKGROUND OF THE INVENTION

The present invention generally relates to a housing device for hoses of fire extinguishers and/or hydrants.

More particularly, the present invention relates to a device configured to perform a safe and effective housing of the nozzle of fire-extinguishing liquid or powder dispensing hoses of fire extinguishers and/or hydrants; practically, an anti-blocking covering plug is inserted into a hole which is made on the control lever of said fire extinguishers.

The types of fire extinguishers and hydrants currently on the market are the following:

- powder portable and wheeled fire extinguishers which are pressurized at 14/15 bar with nitrogen;
- portable and wheeled $CO_2$ fire extinguishers which are pressurized at 65 bar;
- portable water fire extinguishers which are pressurized with nitrogen;
- NASPO UNI 25 hydrants;
- UNI 45 hydrants;
- UNI 70 hydrants.

The types of fire extinguishers and hydrants currently available on the market, however, have never evolved technologically over time, except for the extinguishing materials used, the size and thickness of the tanks, the technology of the valve groups and their fittings (for fire extinguishers) and the construction of the sprayers and of the hoses (for water systems).

Despite the use of these improvements, the possibility of an obstruction of the hose delivery nozzle due to external factors, such as dust and dirt entering or due to the nests of insects, is real for all types of fire extinguishers and hydrants.

If the nozzle of the fire extinguisher or hydrant hose is subjected to infiltration by external elements, the same hose may become unusable or malfunctioning in case of a real need; In fact, periodic checks and inspections and maintenance by the technical staff rarely take account of the possible formation of an obstruction within the hose delivery nozzle of said devices. Moreover, the periodic controls are still too sporadic over time (inspections are normally performed every 6 months) and even though they are carried out by the companies internal staff, the problem is not solved, since very often the company staff is not entirely qualified or too superficial to be able to understand the integrity and functionality of the device, which, on the contrary, should be considered as a first aid and therefore be used in all emergency situations. Despite the technical differences of the products used to extinguish the fire, according to the extinguishing classes, all the above mentioned fire extinguishers have a common feature in being equipped with a hose for dispensing water and/or powder and a nozzle which is usually housed in a hole provided on the delivering handle of the fire extinguisher or hydrant or which is locked to the bottom of the tank of said fire extinguisher or hydrant by means of a hook; in any case, said nozzle may be obstructed due to external factors such as dust, dirt, insect nests, etc., which may compromise the integrity and correct operation of the hose and the whole fire extinguisher or hydrant during its use.

A housing device for hoses of fire extinguishers and/or hydrants having the features of the preamble of the appended claim 1 is also known, for example, from DE2620909A1.

SUMMARY OF THE INVENTION

According to the above-mentioned requirements, the object of the present invention is to overcome the drawbacks of the prior art and in particular to provide a housing device for hoses of fire extinguishers and/or hydrants, which is able to prevent filling and obstructions of the nozzle of said hoses, in order to ensure a proper operation during use.

Another object of the present invention is to provide a housing device for hoses of fire extinguishers and/or hydrants, which is extremely easy and simple to use and which can be made with low costs with respect to the advantages achieved.

These and other objects, within the scope of the present invention, are achieved by a housing device for hoses of fire extinguishers and/or hydrants according to claim 1; other technical details of the device are cited in the subsequent dependent claims. Advantageously, the housing device according to the present invention provides the use of a special cover element, such as a cap, a pan, etc., for housing and protecting the nozzle of a hose of fire extinguishers and/or hydrants, which is placed in a suitable seat provided on the actuating handle of said fire extinguisher and/or hydrant.

BRIEF DESCRIPTION OF THE SEVERAL VIEWS OF THE DRAWINGS

These and other objects and advantages will become more clear from the following description, relating to a preferred embodiment of the housing device for hoses of fire extinguishers and/or hydrants according to the present invention, and from the enclosed drawings in which.

DESCRIPTION OF SPECIFIC EMBODIMENTS OF THE INVENTION

Figure 1:
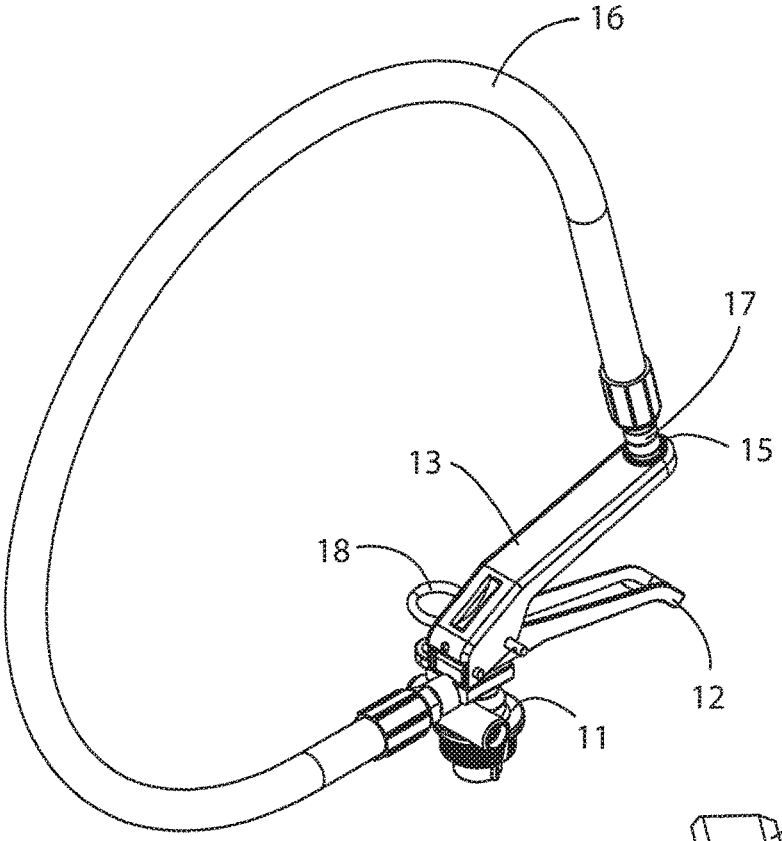
FIG. 1 is a schematic perspective view of a portion of a fire extinguisher, which includes a housing device according to the invention.
Figure 2:
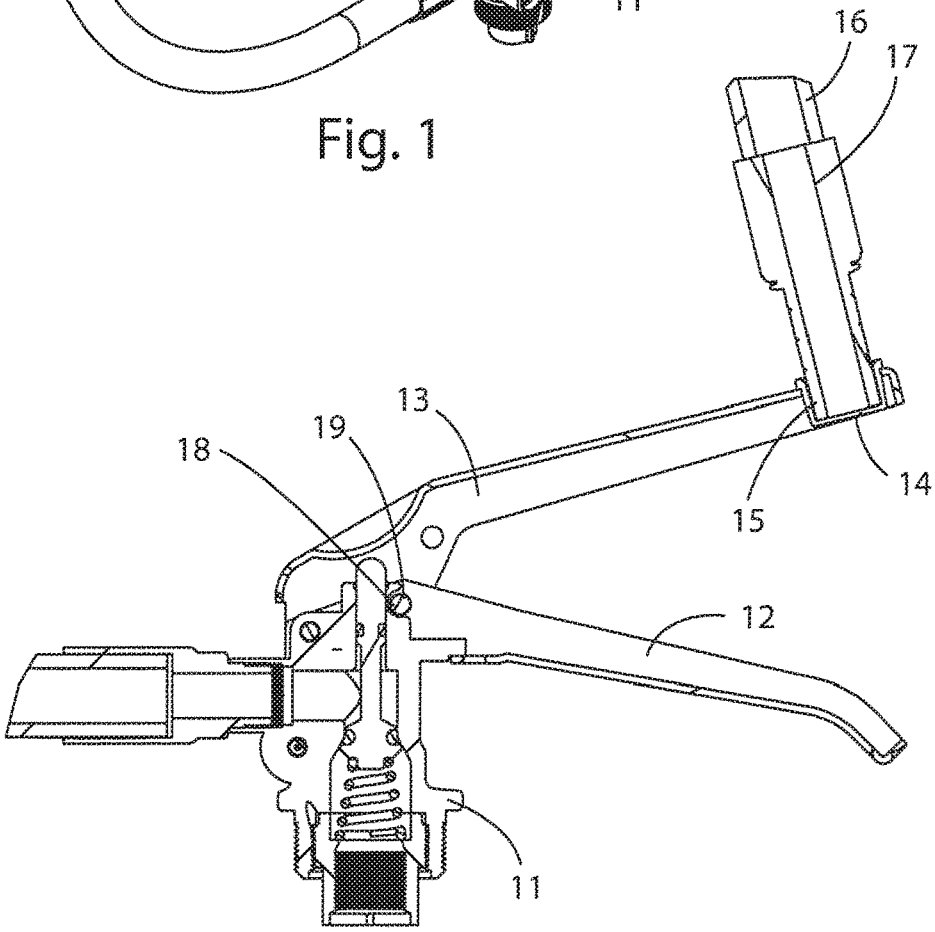
FIG. 2 is a schematic cross-sectional lateral view of the portion of the fire extinguisher shown in FIG. 1, according to the invention.
Figure 3:
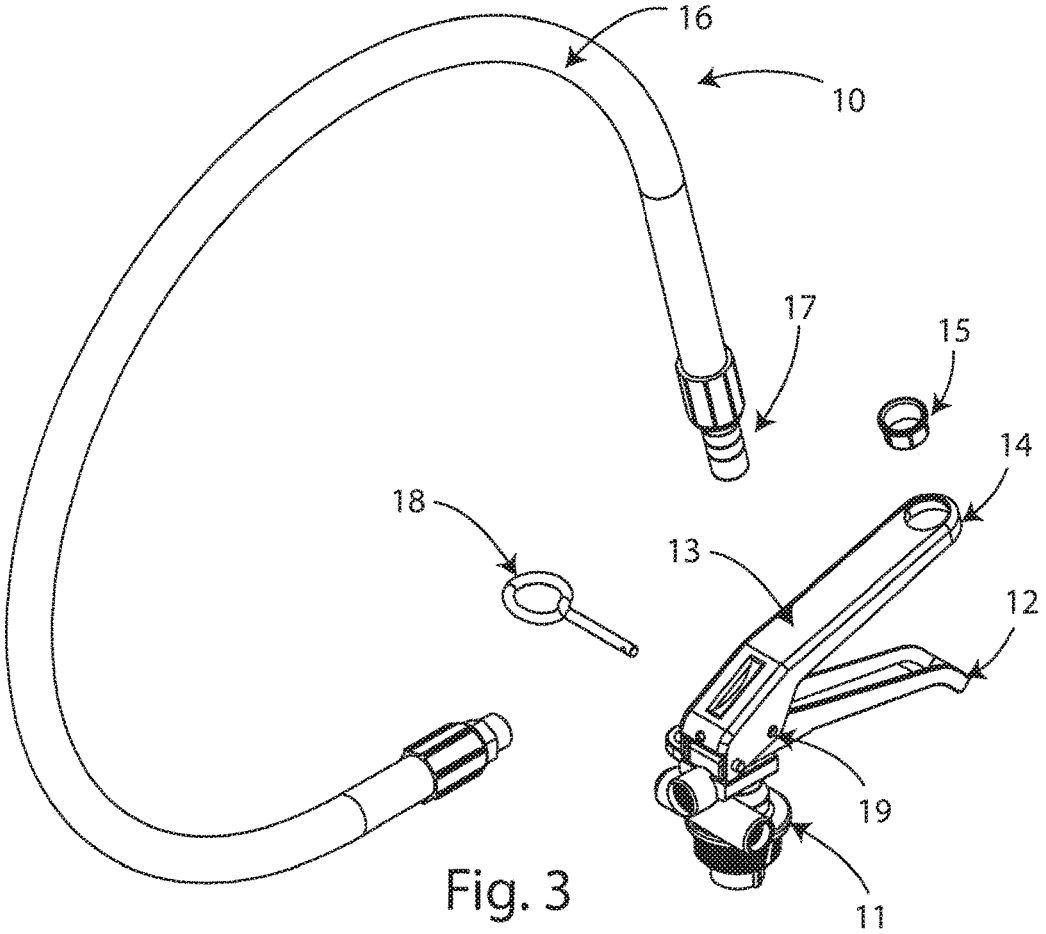
FIG. 3 shows an exploded view of the portion of the fire extinguisher shown in FIG. 1, according to the present invention.
Figure 4A:
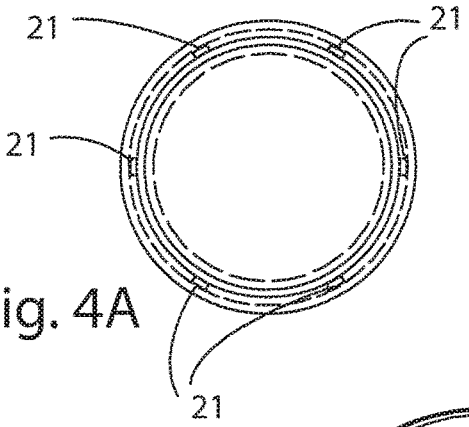
FIG. 4A shows a top view of a covering plug used as a housing device, according to the invention.
Figure 4B:
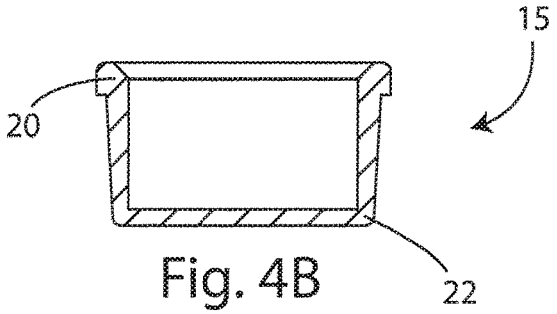
FIG. 4B shows a lateral sectional view of the covering plug shown in FIG. 4A, according to the present invention.
Figure 4C:
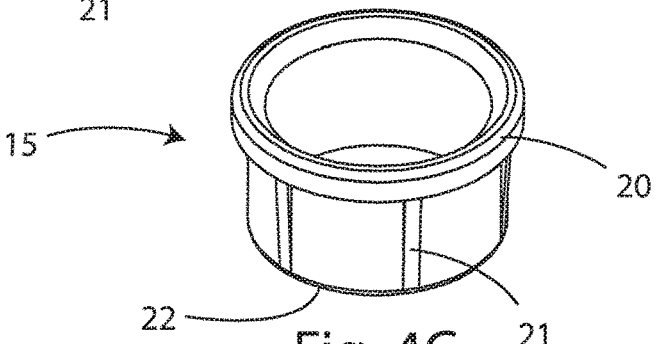
FIG. 4C shows a perspective view of the covering plug shown in FIGS. 4A and 4B, according to the present invention.

First of all, it is to be noted that although the following description and the attached drawings make explicit reference to the use of a housing device for hoses of fire extinguishers, the present invention can be employed similarly and with the same principle to water systems, such as hydrants, water hoses, etc.

With particular reference to the enclosed FIGS. 1, 2, 3, 4A, 4B and 4C, 10 is a portion of the fire extinguisher, substantially comprising a valve group 11 (which is connected to a tank, not shown, containing a liquid or powder product to be dispensed), a hose 16 provided with a nozzle 17, a handle 12, and a control or actuating lever 13.

There is a hole or opening 14 on the control or actuating lever 13, said hole 14 being provided to constitute the housing of the nozzle 17 of the hose 16.

The fire extinguisher portion 10 is also provided with a safety pin 18 of the valve group 11, which is inserted into a suitable seat 19 of the handle 12.

According to the present invention, a cover element 15, such as a cap, a plug, etc., is inserted inside the hole or opening 14 of the actuating lever 13 of the fire extinguisher and said cover element 15 also constitutes, at the same time, the housing seat of the nozzle 17 of the fire extinguisher hose 16 and the protection element for said nozzle 17 from external agents, such as dust, corrosive or polluting substances, cobwebs, insect nests (such as bees), which may cover the hole 14, thus damaging and/or causing malfunctions in the delivery of the liquid and/or of the powder contained in the tank of the fire extinguisher.

Said cover element 15 is constituted by a hollow cylinder, open at the top and having a lower base or bottom wall 22, which is configured to be inserted into the hole or opening 14 of the control lever 13 until the upper opening substantially lies on the same plane passing along the hole 14.

The cover element 15 may preferably be made of polymeric material such as polycarbonate (PC) and acrylonitrile butadiene styrene (ABS) and, as said, has an appropriate shape so that it can be housed inside the hole or opening 14 of the control lever 13 of the fire extinguisher.

For this reason, the cover element 15 can advantageously have a thickening of the upper circular edge 20 and a plurality of slopes or knurls 21 on the lateral surface. The thickening of the upper edge 20, in fact, allows the cover element 15 to lean against the rim of the hole 14 once the cover element 15 is inserted in the hole 14 and the above-mentioned slopes or knurls 21 are configured to squeeze and thus keep the element 15 in its seat, inside the hole 14, thus avoiding that the element 15 goes outside the seat during the insertion and the disengagement of the nozzle 17 of the hose 16.

In practice, according to the present invention, the nozzle 17 of the hose 16 can be inserted into the upper opening of the cover element 15 until said nozzle 17 contacts the lower base 22 of said element 15 when the latter is inserted within the hole or opening 14 of the control lever 13.

In this way, a complete protection of the nozzle 17 is obtained, as it is avoided that the hole or opening 14, which normally constitutes the housing for the nozzle 17 of the hose 16, becomes a receptacle of dust, corrosive substances and/or pollutants, insect nests, etc., thus creating a relevant damage for the nozzle 17.

In fact, since, according to the invention, the nozzle 17 always contacts the lower base 22 of the cover element 15, said nozzle 17 is completely protected even during periods of inactivity of the fire extinguisher and/or during periods among the maintenance operations.

In addition, the solution according to the invention allows the nozzle 17 to be clamped to the suitable housing, thus avoiding the need of fixing the hose 16 and the relative nozzle 17 to the fire extinguisher tank.

Finally, periodic maintenance is more secure and quick, as there is no need to check for any accumulation of external agents such as dirt, dust, insect nests, etc. near the hose housing.

Figure 5:
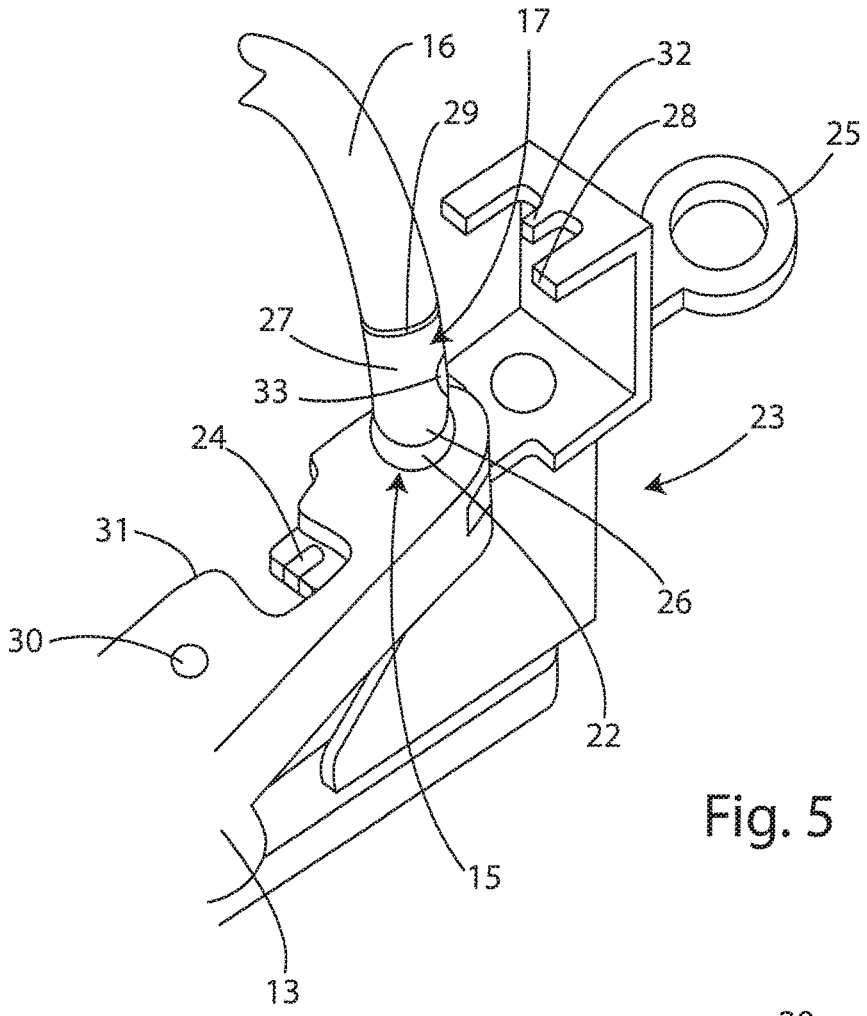
FIG. 5 is a schematic perspective view of a portion of a fire extinguisher including a housing device according to the present invention, as well as a sensor system for detecting the release of the hose of said fire extinguisher from a prefixed seat.
Figure 6:
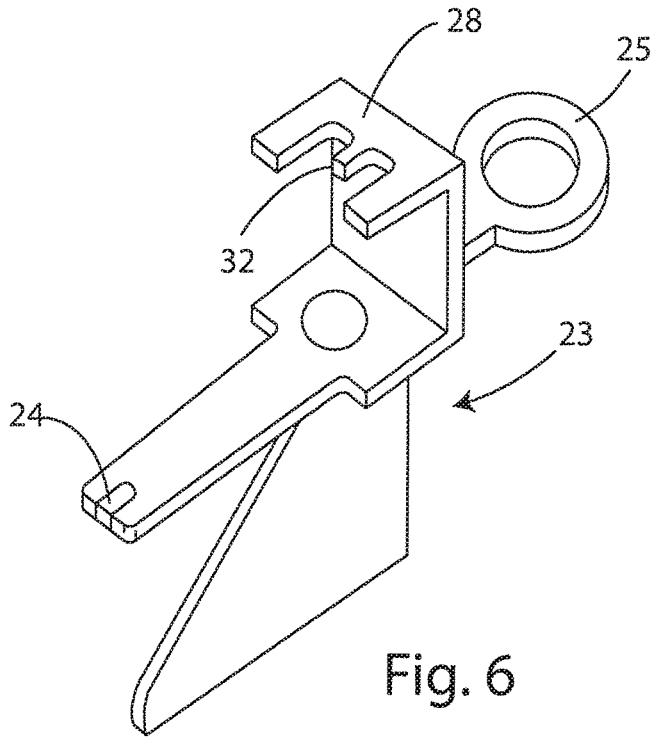
FIG. 6 is a schematic perspective view of a wall coupling element used for fixing the fire extinguisher shown in FIG. 5, according to the present invention.

According to the present invention and with particular reference to the enclosed FIGS. 5 and 6, it is possible to position a magnet 24 inside a locking device constituted by a sort of key or safety shuttle 23, so that, when the key is inserted in correspondence of the fire extinguisher control lever 13, said key locks the lever 13 acting as the safety pin 18 and also blocks the nozzle 17 of the hose 16 inside the cover element 15, thus blocking also the hose 16.

The locking device activates a sensor 30 placed on an electronic board 31 located inside the control lever 13.

This particular arrangement allows, by means of a single sensor 30, a simultaneous and objective checking of the positioning and of the correct operation of three different elements:

1) the presence of the hose 16, which is fixed, by means of the nozzle 17, within the housing provided in the cover element 15;

2) the closure of the nozzle 17 when said nozzle 17 is correctly inserted into the housing of the cover element 15 and is covered by the lower base 22 (the bottom wall) of the cover element 15;

3) the proper insertion of the safety shuttle 23, which locks the control lever 13 in a closed and resting condition of the fire extinguisher, thus avoiding unintentional actuating actions by a user.

The above mentioned locking device avoids the possibility that the hose 16 is removed, preventing it from being accidentally or voluntarily removed and from hanging along the walls of the tank (which would render useless the provision of said cover element 15 for protecting the nozzle 17 of the hose 16), and finally said locking device is able to send signals relating to the proper placement and/or the voluntary and/or accidental withdrawal of the safety shuttle 23 (which allows to act on the control lever 13).

Moreover, the sensor 30 may be used when the fire extinguisher and/or the hydrant is provided with a remote control system present on the PCB 31 which is applied to said fire extinguisher and/or hydrant.

In particular, as shown in the enclosed FIGS. 5 and 6, which show the detail of a possible implementation mode of the above mentioned solution, the safety shuttle 23 which acts as a locking element is inserted in the control lever 13 of the fire extinguisher (FIG. 5) and the same shuttle 23 can be removed, for example by an operator, by pulling the ring 25 and the shuttle 23 from its seat (FIG. 6).

When the hose 16 is placed within the housing of the cover element 15, the end portion 26 of the nozzle 17 is in contact with the bottom wall 22 of the cover element 15, while the side wall 27 of the nozzle 17 is placed in contact with the upper shaped wing 28 of the safety shuttle 23, which, in the form of a fork, blocks in the seat the nozzle 17 by acting on the connection edge 29 between the hose 16 and the nozzle 17 and/or on a pin 32 of the wing 28 which can be inserted into a hole 33 of the nozzle 17; furthermore, the safety shuttle 23, thus inserted in the control lever 13 of the fire extinguisher, in addition to blocking said control lever 13, takes the magnet 24 next to the sensor 30 on the PCB 31 of the remote control system.

The magnet 24 so positioned sends a signal to the PCB 31 relative to the insertion and the presence of the safety shuttle 23.

When the safety shuttle 23 is extracted, the sensor 30, which does not sense the magnetic field of the magnet 24, is able to detect the removal of said shuttle 23 and the possible activation of the fire extinguisher and, in this case, said sensor 30 sends a command for a remote alarm signal.

The technical features of the housing device for hoses of fire extinguishers and/or hydrants, which is the object of the present invention, are clear from the previous description, as well as the related advantages are also clear.

Finally, it is clear that other technical variants can be made to the housing device of the present invention, without departing from the novelty principles inherent in the inventive idea as claimed in the appended claims, as it is clear that in the practical implementation of the invention, materials, shapes and dimensions of the illustrated details may be any according to the needs and they may be replaced with others technically equivalent.

What is claimed is:

1. A housing device for hoses of at least one of fire extinguishers and hydrants, in which said housing device for hoses of at least one of fire extinguisher and hydrant comprises a portion (10) comprises:

at least one valve group (11), which is connected to a tank containing at least one of powder and liquid to be dispensed;

at least one hose (16) provided with a nozzle (17) for delivering said powder and/or liquid contained within said tank;

at least one handle (12);

and at least one control lever (13) on which a hole or opening (14) is provided for housing said nozzle (17) of said hose (16), wherein at least one cover element (15) is inserted in said hole or opening (14), said at least one cover element (15) having at least one seat for inserting said nozzle (17) of said hose (16) and a bottom wall (22) which is placed in contact with said nozzle (17) when the nozzle (17) is inserted in said seat of the cover element (15) wherein said housing for hoses of at least one of fire extinguisher and hydrant is provided with a safety shuttle (23), which is inserted at said control lever (13) and is configured to block said control lever (13) and said nozzle (17) of the hose (16) within a housing of said cover element (15) when said at least one of fire extinguisher and hydrant is in a closed and resting condition, said safety shuttle (23) being provided with a magnet (24) configured to activate a sensor (30) present on a PCB (31) of a remote control system, said PCB (31) being located within said control lever (13); wherein said safety shuttle (23) has a shaped wing (28) which contacts a lateral wall (27) of said nozzle (17) and blocks said nozzle (17) in said housing and in contact with said bottom wall (22) of the cover element (15) by acting on an edge (29) connecting said hose (16) and at least one of said nozzle (17) and on a pin (32) of said shaped wing (28), said pin (32) being configured to be inserted into a hole (33) of the nozzle (17).

2. A housing device according to claim 1, wherein said at least one of fire extinguisher and hydrant is provided with a safety pin (18) of said valve group (11), said pin (18) being inserted into a seat (19) of said handle (12).

3. A housing device as claimed in claim 1, wherein said cover element (15) is a hollow cylinder with said bottom wall (22) provided on the opposite side with respect to said seat where said nozzle (17) of the hose (16) is inserted.

4. A housing device according to claim 1, wherein said cover element (15) has a thickening at a circular edge (20) of said seat where said nozzle (17) is inserted.

5. A housing device as claimed in claim 1, wherein said cover element (15) has a series of slopes or knurls (21) at a lateral surface.

6. A housing device according to claim 1, wherein said cover element (15) is made of polymeric material selected from a group consisting of polycarbonate (PC) and acrylonitrile butadiene styrene (ABS).

7. A housing device according to claim 1, wherein said sensor (30), by detecting the presence of said magnet (24), is able to inform said PCB (31) about the insertion of said safety shuttle (23) on said control lever (13).

8. A housing device according to claim 7, wherein, when said safety shuttle (23) is extracted from said control lever (13), said sensor (30), without detecting the presence of said magnet (24) and detecting a removal of said safety shuttle (23), sends a command for a remote alarm signal.

* * * * *